US008365370B2

(12) United States Patent
Leger

(10) Patent No.: US 8,365,370 B2
(45) Date of Patent: Feb. 5, 2013

(54) DEVICE AND METHOD FOR TRANSFERRING NONWOVEN MATERIAL

(75) Inventor: Joachim Leger, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 717 days.

(21) Appl. No.: 12/574,514

(22) Filed: Oct. 6, 2009

(65) Prior Publication Data

US 2010/0084248 A1 Apr. 8, 2010

(30) Foreign Application Priority Data

Oct. 7, 2008 (EP) ..... 08165977

(51) Int. Cl.
*D01G 25/00* (2006.01)
*D04H 5/08* (2006.01)

(52) U.S. Cl. ..... 28/102; 28/107; 19/296; 19/161.1

(58) Field of Classification Search ..... 28/107, 28/101, 102, 103, 108–114, 104–106; 19/161.1, 19/163, 296, 300, 302; 270/30.1, 30.11, 270/30.03, 30.12, 32, 39.05; 226/195
See application file for complete search history.

(56) References Cited

U.S. PATENT DOCUMENTS

| | | | | |
|---|---|---|---|---|
| 2,428,709 | A * | 10/1947 | Hlavaty | 19/163 |
| 5,060,347 | A * | 10/1991 | Beckers | 19/300 |
| 5,590,442 | A * | 1/1997 | Hirschek et al. | 19/163 |
| 6,195,844 | B1 * | 3/2001 | Jourde et al. | 19/163 |
| 6,434,795 | B1 | 8/2002 | Jourde et al. | |
| 6,662,407 | B2 * | 12/2003 | Bernhardt et al. | 19/161.1 |
| 7,320,154 | B2 * | 1/2008 | Leger | 19/296 |
| 7,320,155 | B2 * | 1/2008 | Leger | 19/296 |
| 2003/0056348 | A1 * | 3/2003 | Dilo et al. | 28/107 |
| 2005/0011060 | A1 * | 1/2005 | Fuchs | 28/107 |
| 2007/0175000 | A1 * | 8/2007 | Dilo et al. | 19/163 |
| 2008/0235915 | A1 * | 10/2008 | Dilo | 19/296 |
| 2008/0305704 | A1 * | 12/2008 | Provost et al. | 442/360 |

FOREIGN PATENT DOCUMENTS

| | | | |
|---|---|---|---|
| DE | 9212215 | U1 | 1/1994 |
| EP | 1285982 | A | 2/2003 |
| EP | 1643022 | A | 4/2006 |

OTHER PUBLICATIONS

English language machine translation of EP 1643022, published Apr. 5, 2006; translation total 14 pages.*

* cited by examiner

*Primary Examiner* — Amy Vanatta
(74) *Attorney, Agent, or Firm* — Jansson Munger McKinley & Shape

(57) ABSTRACT

A device for transferring nonwoven material from a fleece-laying machine to a consolidation device having an endless circulating output conveyor belt of the fleece-laying machine for accepting card webs which are laid on the output conveyor belt from above by the fleece-laying machine, the laid card webs forming the nonwoven material. A first drive unit drives the output conveyor belt at variable speed. In addition, a second drive unit for driving the output conveyor belt at an essentially constant speed is provided at a point which, relative to the first drive unit, is closer to the consolidation device. A hanging storage buffer of the output conveyor belt is thus formed in a section of the output conveyor belt located between the first drive unit and the second drive unit.

15 Claims, 2 Drawing Sheets

DEVICE AND METHOD FOR TRANSFERRING NONWOVEN MATERIAL

CROSS REFERENCE TO RELATED APPLICATION

This application claims priority based on European patent application EP 08 165 977.3 filed Oct. 7, 2008.

FIELD

The present invention pertains to a device and to a method for transferring nonwoven material from a fleece-laying machine to a consolidation device.

BACKGROUND

Fleece-laying machines for laying nonwoven material and consolidation devices installed thereafter for the nonwoven material, e.g., needle looms for needling the nonwoven material, are known.

Fleece-laying machines can be designed as camel-back fleece layers or as horizontal layers. In each case, a laying carriage moves back and forth in a fixed rhythm over an output conveyor belt. At least two web conveyor belts in the fleece-laying machine serve to transport a card web to the laying nip in the laying carriage. The card webs are fed through the laying nip and deposited on the output conveyor belt. Because of the back-and-forth movement of the laying carriage and the forward movement of the output conveyor belt, a multi-layer fleece with the various card web layers lying at an angle to each other is obtained.

To produce nonwoven material with a uniform basis weight, it is standard practice to change the speed of the output conveyor belt in synchrony with the speed of the laying carriage, so that the edges of the card webs are straight and the various layers overlap precisely. This means that the output conveyor belt is moved in cycles at variable speed, wherein, as a rule, the output conveyor belt does not move at all for short periods of the time at the points where the laying carriage reverses direction.

The nonwoven material produced by the fleece-laying machine is then transported onward for consolidation to a consolidation device, e.g., a water-jet consolidation device, or a needle loom, which normally comprise a continuous intake. At the transfer point between the output conveyor belt of the fleece-laying machine and the consolidation device, irregularities occur in the nonwoven material to be consolidated due to the different types of movement which the two machines perform.

SUMMARY

It is an object of the present invention to create a device for the transfer of nonwoven material from a fleece-laying machine to a consolidation device, which is simple in design and which can compensate for the variable transport speeds of the nonwoven material in the fleece-laying machine, as a result of which the nonwoven material can be sent continuously to the consolidation device. Such provides for an increase in the uniformity of the consolidated nonwoven material, and further provides a corresponding method to achieve the same.

According to an aspect of the invention, the device for transferring nonwoven material from a fleece-laying machine to a consolidation device comprises an endless circulating output conveyor belt of the fleece-laying machine for accepting card webs which are laid on the output conveyor belt from above by the fleece-laying machine, the laid card webs forming the nonwoven material. The device further comprises a first drive unit for driving the output conveyor belt at a variable speed, and a second drive unit for driving the output conveyor belt at an essentially constant speed, the second drive unit being arranged, relative to the first drive unit, such that it is closer to the consolidation device. Thus, a hanging storage buffer of the output conveyor belt is formed in a section of the output conveyor belt located between the first drive unit and the second drive unit.

Such an arrangement provides controlled compensation for the differences in speed between the output conveyor belt of the fleece-laying machine and the intake of the consolidation device. This in turn leads to a further increase in the uniformity of the consolidated nonwoven material.

The output conveyor belt is preferably designed as a slatted belt with a plurality of transverse slats. This guarantees the safe transport of the nonwoven material and at the same time makes it possible for the output conveyor belt to hang down to any desired extent.

The second drive unit preferably comprises a toothed driving roller or several parallel drive gears. The first drive unit also preferably comprises a toothed driving roller or several parallel drive gears. These are usually connected directly to the output conveyor belt and are suitable for direct transmission of force.

Alternatively or in addition, the first drive unit can comprise an endless circulating transport means, which comprises an upper strand and which is connected positively or frictionally to an upper strand of the output conveyor belt. This allows the drive means to drive the output conveyor belt by acting on an area of a section of its upper strand. This leads to uniform drive behavior and to an especially reliable and precise forward movement of the output conveyor belt in the area in front of the hanging storage buffer.

An especially suitable type of connection for ensuring the drive of the output conveyor belt is provided by a positive connection. For this purpose, the output conveyor belt preferably comprises inward-projecting teeth, and the endless circulating transport means comprises outward-projecting teeth, which engage with the teeth of the output conveyor belt in the area of the upper strand.

A preferred method for transferring nonwoven material from a fleece-laying machine to a consolidation device includes the steps of:

- providing a fleece-laying machine having an output conveyor belt for receiving from above the nonwoven material laid by the fleece-laying machine;
- providing a consolidation device for the nonwoven material downstream of the fleece-laying machine;
- driving the output conveyor belt at variable speed by means of a first drive unit; and
- continuously driving the output conveyor belt by means of a second drive unit arranged at a point which, relative to the first drive unit, is closer to the consolidation device to form a hanging storage buffer in a section of the output conveyor belt between the first drive unit and the second drive unit.

As an alternative to the endless circulating transport means described above, which is connected frictionally or positively to the upper strand of the output conveyor belt, a section of the upper strand of the output conveyor belt can be guided over a smooth surface before arriving at the hanging storage buffer. In this case, it may be sufficient to provide only one first toothed driving roller or several parallel first drive gears to move the output conveyor belt forward, toward the hanging storage buffer.

BRIEF DESCRIPTION OF THE DRAWINGS

Additional details and advantages of the present invention can be derived from the following description, which refers to the drawings.

DETAILED DESCRIPTION

Figure 1:
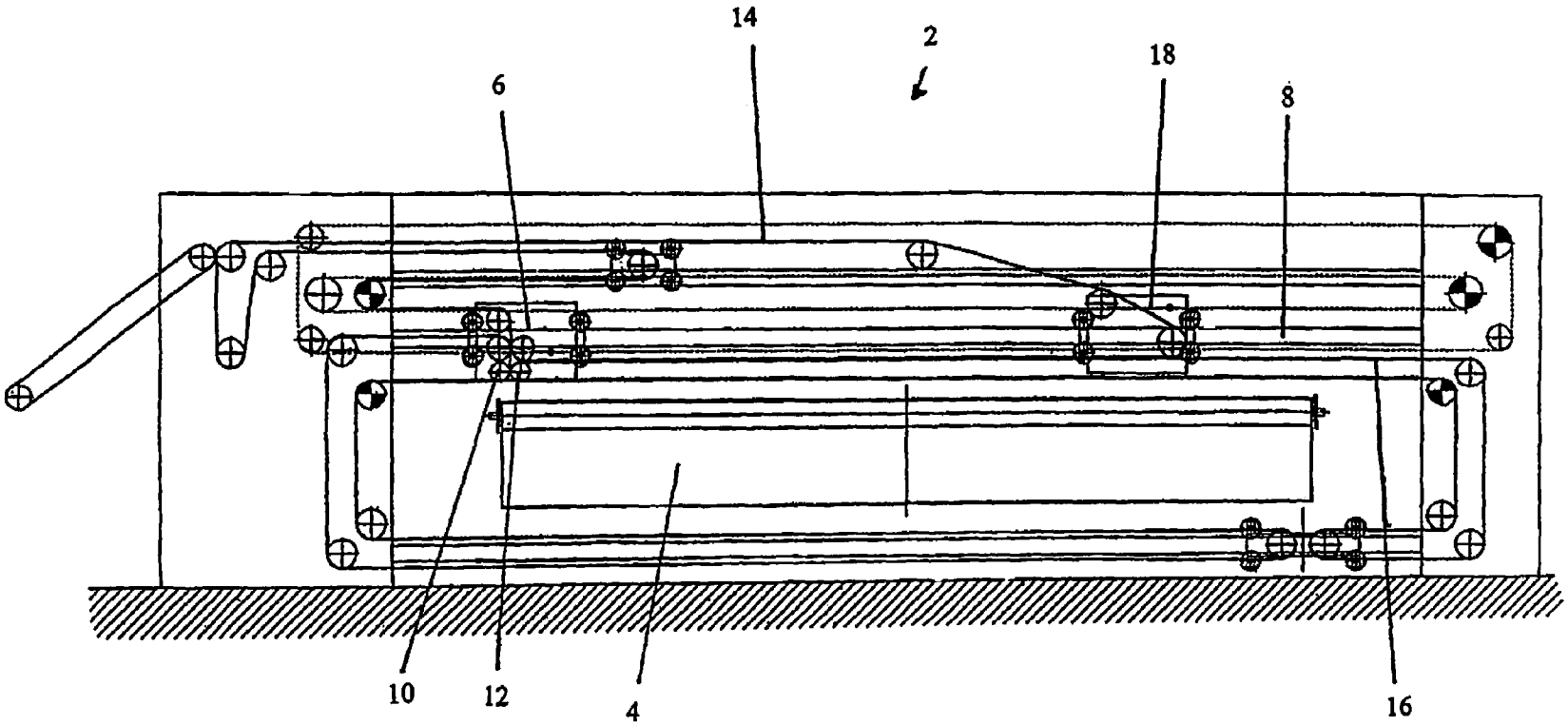
FIG. 1 shows a schematic diagram of a fleece-laying machine with an output conveyor belt.

FIG. 1 shows a schematic diagram of the end of one embodiment of a fleece-laying machine 2 from which an output conveyor belt 4 extends. Output conveyor belt 4 is illustrated as an endless circulating output conveyor belt and has the purpose of carrying away the laid nonwoven material (not shown) in a transport direction perpendicular to the plane of the drawing. A laying carriage 6 can be moved back and forth on rails or tubes 8 across output conveyor belt 4. Two rolls 10, 12 in the carriage form a laying nip for the card web (not shown). The card web is guided to this laying nip in fleece-laying machine 2 by means of at least two card web conveyor belts 14, 16. In one preferred embodiment, fleece-laying machine 2 is designed as a horizontal layer, in which an upper carriage 18, which is arranged essentially at the same level as laying carriage 6, is also supported such that it can be moved on rails or tubes 8 transversely to the transport direction of output conveyor belt 4. Rails or tubes 8 can be the same rails or tubes on which laying carriage 6 is also movably supported. During operation, i.e., while laying carriage 6 is executing its back-and-forth movements across output conveyor belt 4 to lay the card webs onto output conveyor belt 4, upper carriage 18 moves in the same direction but at a slower speed.

The movements of laying carriage 6 and of upper carriage 18 are coordinated with each other in such a way that, while the card web is being supplied to fleece-laying machine 2 at uniform speed, it is possible for the card web to be deposited in a controlled manner onto output conveyor belt 4 without stretching or compression within fleece-laying machine 2. Thus, upper carriage 18 travels in the same direction as laying carriage 6 but on average at only half its speed. Account is also taken of the fact that laying carriage 6 must be braked to a stop and then accelerated again at the points where it reverses direction. The card web may being supplied at variable speed when, for example, a cyclically operating web drafter (not shown) is installed upstream of fleece-laying machine 2 to produce an alternating thickness in the card web for the purpose of achieving a transverse profiling of the laid nonwoven material. Such construction allows, with the help of the independently controlled movements of upper carriage 18 and lower carriage 6, buffering of the card web within fleece-laying machine 2.

According to this exemplary embodiment, three belts and output conveyor belt 4 are present in fleece-laying machine 2. Other embodiments of the invention can also be applied to any other type of fleece-laying machines, including those with two belts and one output conveyor belt. The invention is also applicable to oppositely-moving fleece-laying machines, in which upper carriage 18 and laying carriage 6 move in opposite directions, as well as to camel-back fleece layers.

Common to all fleece-laying machines 2 is that laying carriage 6 is braked to a stop at the points where it reverses direction and must then be accelerated again in the opposite direction. In modern fleece-laying machines 2, the speed of card web deposition is also reduced correspondingly during the braking and acceleration phase to avoid an increase in the thickness of the edges of the laid nonwoven material. At the same time, output conveyor belt 4 is also adapted in a controlled manner to this cycle of movements, which means that, at the times when laying carriage 6 is braked and accelerated again in the opposite direction, output conveyor belt 4 also travels at a correspondingly slower speed. This is necessary to guarantee a precise overlap of the various card web layers, including at the edges. If the output conveyor belt 4 were to continue to travel at constant speed, such precise overlapping would not be possible. The speed of output conveyor belt 4 can drop to zero in this situation. The overall result, therefore, is that the output conveyor belt 4 executes timed movements at various speeds.

Figure 2:
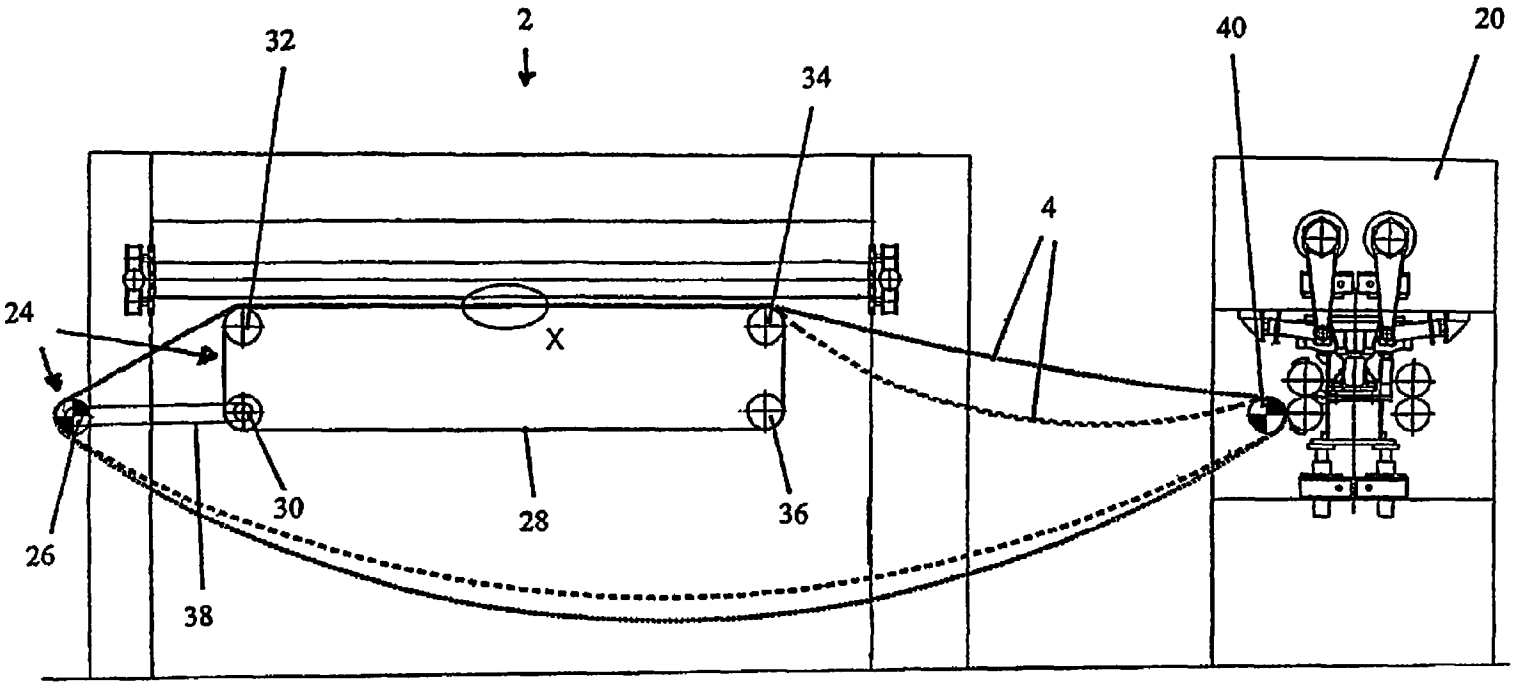
FIG. 2 is a schematic side view of one embodiment of the device for transferring nonwoven material according to the invention.

FIG. 2 is a side view of the fleece-laying machine of FIG. 1 after it has been rotated 90° from the position illustrated in FIG. 1. Output conveyor belt 4 is shown in this drawing in two different possible positions, one of them indicated in dotted line and the other in dashed line. In the area of its upper strand, the output conveyor belt 4 travels from left to right and guides the laid nonwoven material (not shown) to a downstream consolidation device 20, which, for example, is shown here as a needle loom. Any other type of consolidation device 20 can be used, including but not limited to a water jet consolidation device. In the example shown here, the output conveyor belt 4 travels up to and into consolidation device 20. It is also possible for output conveyor belt 4 to transfer the nonwoven material to a feed belt of consolidation device 20. In FIG. 2, for the sake of clarity, upper carriage 18 and laying carriage 6 of fleece-laying machine 2 are not shown.

Figure 3B:
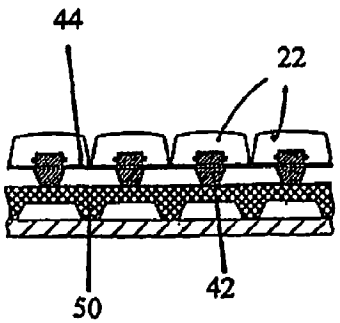
FIGS. 3*a* and 3*b* are enlarged schematic side views of two alternative embodiments of the area designated "X" in FIG. 2.
Figure 3A:
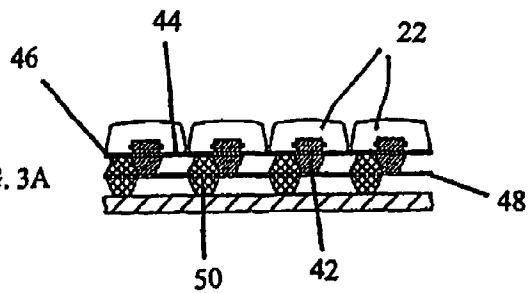

In one preferred embodiment, the output conveyor belt 4 is designed as a slatted belt with a plurality of transverse slats 22 (see FIGS. 3*a* and 3*b*). This permits considerable freedom of movement between individual transverse slats 22 and thus allows output conveyor belt 4 to conform to any type of curved path, wherein simultaneously the laid nonwoven material is given compact support. As can be seen in FIG. 2, a first drive unit 24 is provided, which drives output conveyor belt 4 at variable speed. First drive unit 24 preferably comprises a toothed driving roller or several parallel drive gears 26, which are preferably partially wrapped by output conveyor belt 4. In each case, a secure connection must exist between driving roller 26 and output conveyor belt 4. The sets of teeth on driving roller 26 or on the individual drive gears are a predetermined distance apart from each other. First drive unit 24 is actuated in accordance with the previously described course of the timed movements of output conveyor belt 4, which is itself determined by the course of the movements of laying carriage 6. The control function for first drive unit 24 can be integrated into the control unit of fleece-laying machine 2.

First drive unit 24 is therefore responsible for driving the endless circulating output conveyor belt 4 at variable speed. In one preferred embodiment as shown, first drive unit 24 also comprises an endless circulating transport means 28, which is also suitable for carrying along a section of the upper strand of output conveyor belt 4 in the conveying direction. Endless circulating transport means 28 can be designed in any one of the various forms of a belt, which will be discussed in greater detail below with reference to FIGS. 3*a* and 3*b*. Accordingly, a frictional or positive connection is established between endless circulating transport means 28 and output conveyor belt 4. Endless circulating transport means 28 is preferably guided around four deflecting rollers 30, 32, 34, 36, which are arranged in the manner of a rectangle and at least one of which must be driven. The drive of this at least one of the deflecting rollers 30, 32, 34, 36 may be synchronized with the drive of driving roller 26. This can easily be done by connecting driving roller 26 to the driven deflecting roller by means of an endless circulating chain 38. All these measures serve to transport the section of the upper strand of the output conveyor belt 4 in a secure and guided manner at variable speed.

As Illustrated in FIG. 2, driving roller 26 (in the alternative drive gears may be provided) is arranged in the outer left area, i.e., as far away as possible from consolidation device 20. It is also possible to arrange such driving roller 26, drive gears, or two or more arrangements of several parallel drive gears in an area where deflecting roller 34 is shown in FIG. 2. In such a case, endless circulating transport means 28 can under certain conditions be omitted, and instead, the upper strand of output conveyor belt 4 can be guided across, for example, an extremely smooth surface. When endless circulating transport means 28 is used, deflecting rollers 30, 32, 34, 36 can also be formed as arrangements of several gears.

As illustrated in the preferred embodiment of FIG. 2, a second drive unit 40 is provided. Second drive unit 40 is located at a point which, relative to first drive unit 24, is closer to consolidation device 20, and which, in the example shown here, is also designed as a toothed driving roller or as several parallel gears, which are partially wrapped by output conveyor belt 4. The second drive unit 40 is preferably located at the point of the overall machine which is closest to consolidation device 20. Second drive unit 40 is correlated with the intake speed of consolidation device 20 and thus has a different speed curve than first drive unit 24. In the normal case, second drive unit 40 is driven continuously and preferably also at a constant speed, because this reflects the current method used to feed consolidation devices 20. It is also possible to program a variable intake speed.

The overall design of the machine therefore makes it possible for output conveyor belt 4 to hang down in an area of the upper strand of output conveyor belt 4. Such a hanging section of output conveyor belt 4 acts as a storage buffer to compensate for the different speeds of first drive unit 24 and of second drive unit 40. Drive units 24, 40 are actuated in such a way that the speed differences cancel each other out on average, so that the sag becomes neither to large nor too small. In the example shown here, the dotted lines show the extreme case in which output conveyor belt 4 has no sag at all, whereas the dashed lines show the case in which output conveyor belt 4 sags to a certain extent. The free-hanging lower strand of output conveyor belt 4 rises and falls in correspondence with the degree to which the section of the upper strand of output conveyor belt 4 sags.

FIGS. 3*a* and 3*b* show two preferred embodiments of the design of endless circulating transport means 28. In both cases, output conveyor belt 4 is designed as a slatted belt with transverse slats 22 and comprises inward-projecting teeth 42. The teeth 42 are preferably snapped into a textile belt 44, which preferably consists of woven polyester fabric and which, in one embodiment, is about 40 mm wide. In FIG. 3*a*, circulating transport means 28 consists of at least one double-toothed belt, in which outward-projecting teeth 46 engage with inward-projecting teeth 42 of output conveyor belt 4 and thus carry it along. The connecting element between teeth 46 is preferably a textile belt 48, which is designed in the same way as textile belt 44. Chains may also be used.

In the embodiment of FIG. 3*b*, endless circulating transport means 28 is designed as a single-toothed belt, in which the teeth 50 project inwardly. A frictional connection is present between the hard back surface of the toothed belt and inward-projecting teeth 42 of output conveyor belt 4. By way of example, toothed belt 28 is made of PVC or polyamide, whereas inward-projecting teeth 42 of output conveyor belt 4 are made of polyamide. In this case, it is advantageous for toothed belt 28 to travel at a somewhat higher speed than the drive gears 26 so that the output conveyor belt 4 can be held taut. This can be achieved in the case of the embodiment shown in FIG. 2 by giving each gear 30 one less tooth or several fewer teeth than there are on each drive gear 26.

In this way, a device and a method for transferring nonwoven material from a fleece-laying machine to a consolidation device are created in which the different speed curves of the output conveyor belt 4 of the fleece-laying machine 2 and of the intake of the consolidation device 40 can be easily coordinated and compensated.

What is claimed is:

1. A device for transferring nonwoven material from a fleece-laying machine to a consolidation device, comprising:

an endless circulating output conveyor belt of the fleece-laying machine for accepting card webs which are laid on the output conveyor belt from above within the fleece-laying machine, the laid card webs forming the nonwoven material;

a first drive unit for driving the output conveyor belt at a variable speed; and a second drive unit for driving the output conveyor belt at an essentially constant speed, the second drive unit being arranged at a point which, relative to the first drive unit, is closer to the consolidation device;

wherein a hanging storage buffer of the output conveyor belt is formed in a section of the output conveyor belt located between the first drive unit and the second drive unit.

2. The device of claim 1 wherein the output conveyor belt is designed as a slatted belt with a plurality of transverse slats.

3. The device of claim 1 wherein the second drive unit comprises a toothed driving roller or several parallel drive gears.

4. The device of claim 1 wherein the first drive unit comprises a toothed driving roller or several parallel drive gears.

5. The device of claim 1 wherein the first drive unit comprises an endless circulating transport means, which comprises an upper strand, which is positively or frictionally connected to an upper strand of the output conveyor belt.

6. The device of claim 5 wherein the output conveyor belt comprises inwardly-projecting teeth.

7. The device of claim 6 wherein the endless circulating transport means comprises outwardly-projecting teeth, which engage with the teeth of the output conveyor belt in an area of the upper strand.

8. A method for transferring nonwoven material from a fleece-laying machine to a consolidation device, comprising:

providing a fleece-laying machine having an output conveyor belt for receiving from above the nonwoven material laid within the fleece-laying machine;

providing a consolidation device for the nonwoven material downstream of the fleece-laying machine;

driving the output conveyor belt at variable speed by means of a first drive unit; and continuously driving the output conveyor belt by means of a second drive unit arranged at a point which, relative to the first drive unit, is closer to the consolidation device to form a hanging storage buffer in a section of the output conveyor belt between the first drive unit and the second drive unit.

9. The method of claim 8 wherein the first drive unit comprises an endless circulating transport means, an upper strand of which is frictionally connected to a section of an upper strand of the output conveyor belt and thereby driving said output conveyer belt through the frictional connection.

10. The method of claim 8 wherein the first drive unit comprises an endless circulating transport means, an upper strand of which is positively connected to a section of an upper strand of the output conveyor belt and thereby driving said output conveyer belt through the positive connection.

11. The method of claim 10 wherein the positive connection is accomplished by teeth.

12. The method of claim 9 wherein the endless circulating transport means is driven at least at the same speed as a first toothed driving roller or a first arrangement of a plurality of parallel first drive gears, which form part of the first drive unit.

13. The method of claim 10 wherein the endless circulating transport means is driven at least at the same speed as a first toothed driving roller or a first arrangement of a plurality of parallel first drive gears, which form part of the first drive unit.

14. The method according to claim 12 wherein the endless circulating transport means is driven at a slightly greater speed than the first toothed driving roller or the first arrangement of the plurality of parallel first drive gears.

15. The method according to claim 13 wherein the endless circulating transport means is driven at a slightly greater speed than the first toothed driving roller or the first arrangement of the plurality of parallel first drive gears.

* * * * *